United States Patent [19]

Ohishi

[11] Patent Number: 4,784,103

[45] Date of Patent: Nov. 15, 1988

[54] METHOD FOR CONTROLLING FUEL INJECTION FOR AUTOMOTIVE ENGINES

[75] Inventor: Hiroshi Ohishi, Hohya, Japan

[73] Assignee: Fuji Jukogyo Kabushiki Kaisha, Tokyo, Japan

[21] Appl. No.: 72,160

[22] Filed: Jul. 10, 1987

[30] Foreign Application Priority Data

Jul. 14, 1986 [JP] Japan ..... 61-166407

[51] Int. Cl.[4] ..... F02M 51/00; F02D 41/08; F02D 41/12

[52] U.S. Cl. ..... 123/493; 123/339; 123/494

[58] Field of Search ..... 123/339, 440, 478, 480, 123/486, 489, 491, 492, 493, 494

[56] References Cited

U.S. PATENT DOCUMENTS 4,010,717 3/1977 Taplin ..... 123/492
4,487,190 12/1984 Isobe ..... 123/492
4,495,921 1/1985 Sawamoto ..... 123/480 X
4,543,937 10/1985 Amano et al. ..... 123/491
4,545,355 10/1985 Takao et al. ..... 123/440 X
4,643,154 2/1987 Matsuno et al. ..... 123/486 X

FOREIGN PATENT DOCUMENTS 58-107825 6/1983 Japan .

*Primary Examiner*—Willis R. Wolfe
*Attorney, Agent, or Firm*—Martin A. Farber

[57] ABSTRACT

A basic fuel injection time is obtained based on engine speed and intake-air pressure in an intake passage of an engine downstream of a throttle valve of the engine. The basic fuel injection time is corrected by a correcting value based on a constant for a fuel injector and capacity of a chamber formed in an intake passage and on variation in intake-air pressure at every one rotation of a crankshaft of the engine when the idling state of the engine or throttle rapid closing are detected.

7 Claims, 3 Drawing Sheets

FIG. 1
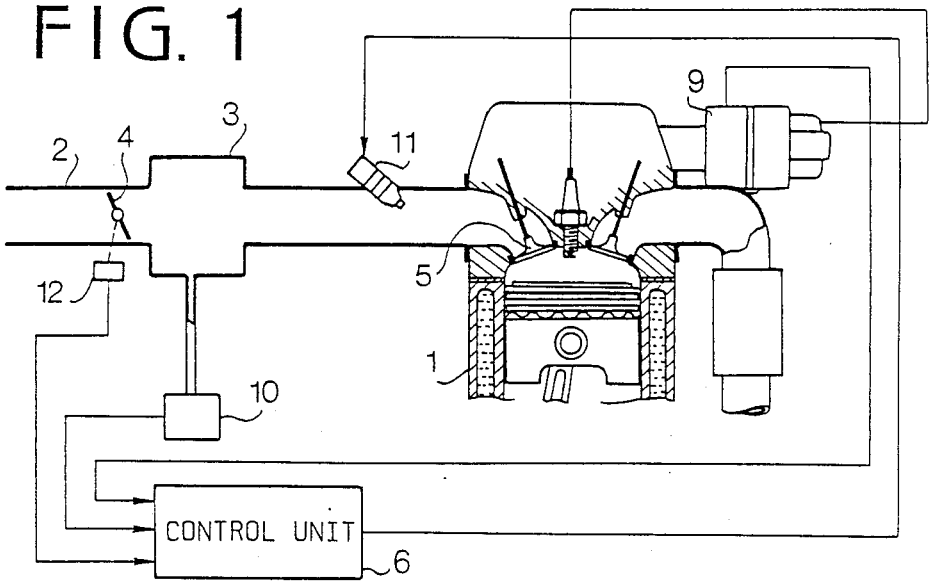
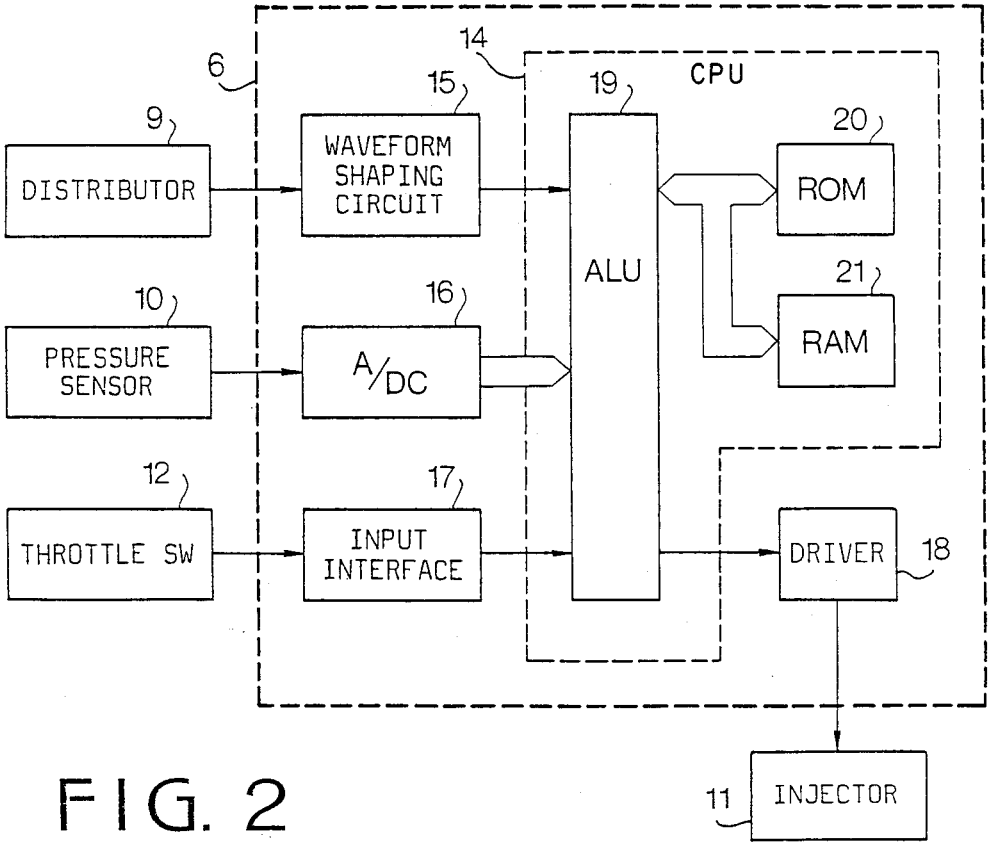
FIG. 2

FIG. 3a
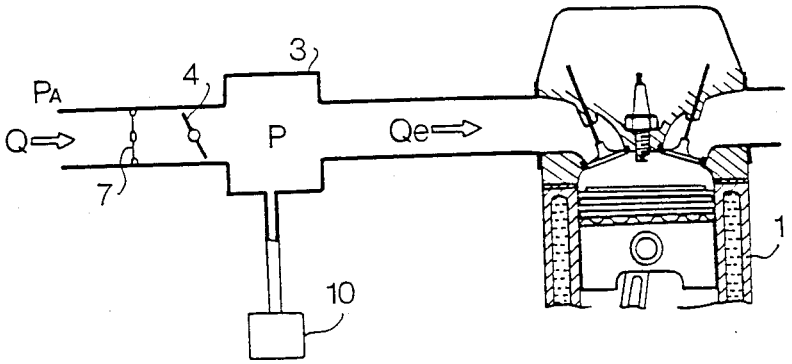
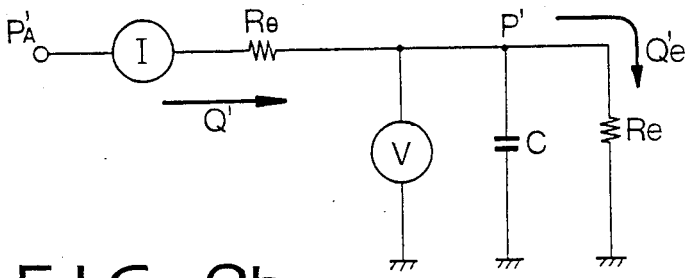
FIG. 3b

METHOD FOR CONTROLLING FUEL INJECTION FOR AUTOMOTIVE ENGINES

BACKGROUND OF THE INVENTION

The present invention relates to a method for controlling fuel injection for an automotive engine, and more particularly for a fuel injection system employed with an intake-air pressure detecting method. In an ordinary fuel injection system employed with an intake-air quantity detecting method, an airflow meter is provided in an intake passage at a position upstream of a throttle valve to detect the quantity of intake air (Q). Basic fuel injection time of period Tp is determined by a calculation of Tp =Q/N (N is engine speed).

In the fuel injection control system dependent on intake-air pressure (Japanese Patent Laid Open No.58-107825), the quantity of intake-air is indirectly detected by the value of the pressure of intake-air. The intake-air pressure increases with decrease of engine speed and decreases with increase of engine speed. However, the variation of the intake-air pressure delays because of the volume of the intake system.

FIG. 5 shows variations of engine speed N, intake-air pressure P and engine torque T at idling of an engine.

If engine speed at idling varies as the curve N because of external disturbance, intake-air pressure should vary as a curve P' theoretically. However, the intake-air pressure varies actually as the curve P with a delay because of the volume of the air intake system. Since the basic fuel injection time Tp is determined by the pressure P, the engine torque varies as the curve T with a phase delay of about 270° with respect to the variation of the engine speed N. Namely, at a point A where the engine speed is at a maximum deceleration, the engine torque is minimum, and at a point B where the engine speed is at a maximum acceleration, the torque is maximum.

Accordingly, the variation of the idling engine speed is maintained without damping.

SUMMARY OF THE INVENTION

The object of the present invention is to provide a method which decreases variation of idling speed of an engine to stabilize the speed.

The other objects and features of this invention will become understood from the following description with reference to the accompanying drawings.

BRIEF DESCRIPTION OF DRAWINGS

FIG. 1 is a schematic diagram showing a system to which the present invention is applied;

FIG. 2 is a block diagram showing a control system;

FIGS. 3*a* and 3*b* are schematic views of an air intake system;

DETAILED DESCRIPTION OF THE PREFERRED EMBODIMENT

Figure 4A:
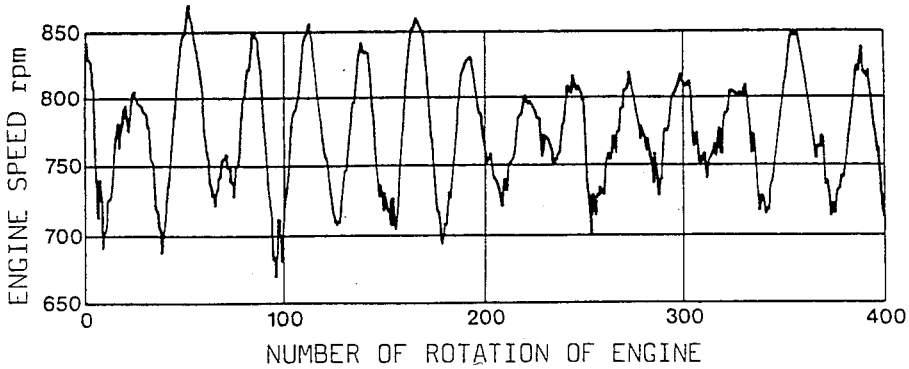
FIGS. 4*a*, 4*b* and 5 are graphs showing variations of engine speeds.

Referring to FIG. 1, in an intake passage 2 of an engine, a throttle chamber 3 is provided downstream of a throttle valve 4 so as to absorb the pulsation of intake-air. Fuel injectors 11 are provided in the intake passage 2 at adjacent intake valves 5 of the engine so as to supply fuel to each cylinder 1 of the engine. A pressure sensor 10 is provided for detecting the pressure of intake-air in the chamber 3 and for producing an intake-air pressure signal. A detected signal is supplied to a control unit 6 consisting of a microcomputer. A distributor 9 produces an engine speed signal for the control unit 6. The control unit 6 determines a basic quantity of fuel injected from the injectors 11 dependent on the intake-air pressure signal and the engine speed signal, and supplies a signal to the injectors 11. In order to detect the idling state of the engine, a throttle position switch 12 is provided adjacent the throttle valve 4. The throttle position switch 12 is turned on when the throttle valve 4 completely closes. An ON-signal from the switch 12 is applied to the control unit 6 to correct the basic fuel injection time Tp.

Referring to FIG. 2, the control unit 6 comprises a central processor unit CPU 14 having an arithmetic and logic circuit ALU 19, a read only memory ROM 20, and a random access memory RAM 21. The control unit 6 operates in accordance with a program stored in the ROM 20. A waveform shaping circuit 15 is supplied with the engine speed signal from the distributor 9 for shaping waveforms of the signal. An A/D converter 16 (A/DC) is supplied with an analog voltage signal from the pressure sensor 10 to convert the analog voltage signal into a digital signal. An input interface 17 is provided for determining an ON or OFF-signal from the throttle position switch 12 and an output signal of the interface 17 is supplied to CPU 14. A driver 18 produces a pulse signal for driving the injectors 11 in responsive to an output signal of the CPU 14.

The engine speed signal from the waveform shaping circuit 15 and intake-air pressure signal from the A/D converter 16 are stored in the RAM 21 through the ALU 19. The basic fuel injection time Tp is calculated based on the stored data in the RAM and a map stored in the ROM, for driving the injectors 11.

The relationship between the intake-air pressure detecting method and the intake-air quantity detecting method is described hereinafter.

Referring to FIGS. 3*a* and 3*b*, the air intake system schematically illustrated in FIG. 3*a* approximately equals to the electric circuit of FIG. 3*b*. Namely, the pressure P in the intake passage downstream of the throttle valve 4 corresponds to the voltage P', the quantity of intake-air passing through an airflow meter 7 in the intake passage at upstream of the throttle 4 corresponds to current Q', the airflow meter 7 corresponds to a current meter I and the pressure sensor 10 corresponds to a voltage meter V in FIG. 3*b*. $P_A$ represents pressure at upstream of the throttle valve 4 and Qe represents actual quantity Qe of air induced in the cylinder 1.

In FIG. 3*b* $R_\theta$ is a resistance at the throttle valve 4, C is a capacity for the chamber 3 and Re is an intake resistance of the cylinder 1. The relationship between the current Q' detected by the current meter I and the voltage P' detected by the voltage meter V is expressed as follows. Q'=Qe'+C(dP'/dt) namely $$Q=Qe+C\,(dP/dt) \tag{1}$$

Basic fuel injection time Tp is $$Tp=K\cdot Q/N \tag{2}$$

where K is a constant for an injector.

A basic fuel injection time Tp obtained by the intake-air pressure P is $$Tp = Tp\,(P, N) \approx K \cdot Qe/N \quad (3)$$

The Tp is obtained from a lookup table in ROM 20 in accordance with pressure P and engine speed N.

Substituting the Q of the equation (2) with the equation (1), $$Tp = K \cdot Qe/N + K \cdot C\,(dP/dt) \times 1/N \quad (4)$$

Since the first term of equation (4) is the equation (3), $$Tp = Tp\,(P,N) + K \cdot C\,(dP/dt) \times 1/N \quad (5)$$

The second term of the equation (5) can be regarded as a correcting quantity for the basic injection time at idling of the engine. The fuel injection time dependent on the equation (5) is equivalent to the fuel injection time obtained by the intake-air quantity. Accordingly, the variation of engine speed at idling and reduction of the engine speed at throttle rapid closing can be prevented by supplying the fuel dependent on the equation (5).

Figure 4B:
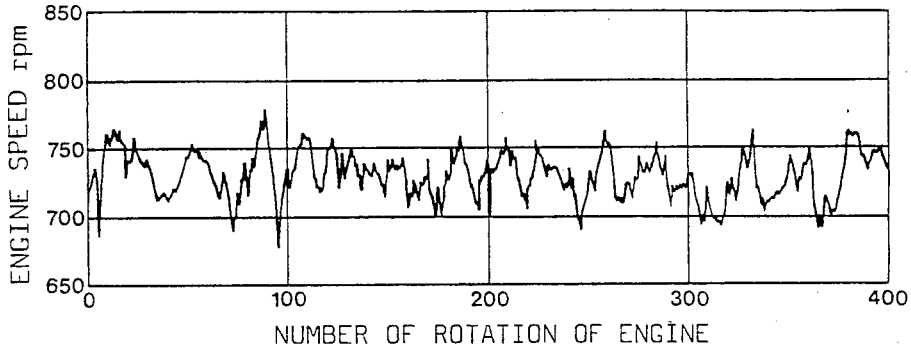
Figure 5:
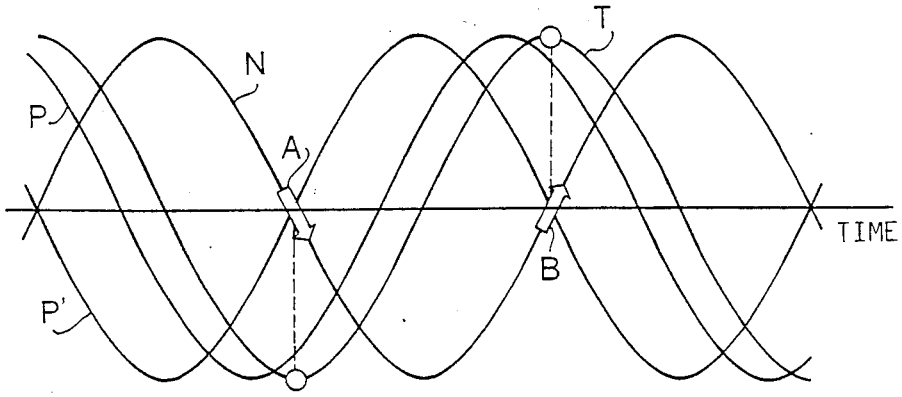

FIG. 4*a* shows variation of idling speed without a correcting quantity where the deviation from the desired idling speed is 42.4 rpm (mean value), causing hunting. FIG. 4*b* shows variation of idling speed by corrected fuel injection time where the deviation is 18.0 rpm and hunting is prevented.

The second term of the equation (5) can be simplified, as described hereinafter.

The second term (TPIDL) of the equation is $$T_{PIDL} = K \times C\,(dP/dt) \times 1/N \quad (6)$$

If the intake-air pressure at time t is P and the intake-air pressure at time $t_o$ is $P_o$ $$dP/dt = \lim_{t - t_o \to 0} (P_o/t - t_o) \quad (7)$$

If one rotating time of the crankshaft of the engine is $\Delta T$, $$1/N = \Delta T \quad (8)$$

From the equation (7), (8), the equation (6) is $$T_{PIDL} = K \times C \times \lim_{t - t_o \to 0} (P - P_o/t - t_o) \times \Delta T \quad (9)$$

If times t and $t_o$ are determined so as to have $t - t_o = \Delta T$, $t - t_o$ becomes sufficiently small. Accordingly, the equation (9) is $$T_{PIDL} = K \times C \times (P \cdot P_o) \quad (10)$$

In other words, the equation (10) means the calculation based on the intake-air pressure at every one rotation of the crankshaft. Since the equation (10) does not include a differentiation (dP/dt), the calculation is simplified and the capacity of ROM 20 can be reduced.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A method for controlling fuel injection for an automotive engine comprising:

determining constants of an injector for the fuel injection and of a capacity of a chamber formed in an intake passage of the engine;

detecting engine speed and intake-air pressure in the intake passage downstream of a throttle valve of the engine;

calculating a basic fuel injection time based on the detected engine speed and intake-air pressure;

said detecting intake-air pressure includes detecting the intake-air pressure at every one rotation of a crankshaft of said engine;

calculating the difference between the detected intake-air pressures at every one rotation of the crankshaft;

correcting the basic fuel injection time by adding thereto a correcting value which is the product of said constants and said difference.

2. The method according to claim 1 wherein said method comprising, detecting idling state of the engine or throttle rapid closing based on throttle position;

correcting the basic fuel injection time when the idling state of the engine or throttle rapid closing is detected.

3. The method according to claim 1, wherein said one rotation equals 360° of rotation of the crankshaft.

4. A method for controlling fuel injection for an automotive engine having an intake passage with a throttle valve disposed in the intake passage comprising:

determining a constant of an injector for the fuel injection;

detecting engine speed and intake-air pressure in the intake passage downstream of the throttle valve;

calculating a basic fuel injection time based on the detected engine speed and intake-air pressure;

said detecting intake-air pressure includes detecting the intake-air pressure at every one rotation of a crankshaft of said engine;

calculating the difference between the detected intake-air pressures at every one rotation of the crankshaft;

correcting the basic fuel injection time by adding thereto a correcting value which is the product of said constant and said difference.

5. The method according to claim 4, wherein said one rotation equals 360° of rotation of the crankshaft.

6. An apparatus for controlling fuel injection by a fuel injector having a constant factor of fuel injection time for an automotive engine having an intake passage with a throttle valve disposed in the intake passage comprising:

means for detecting engine speed and intake-air pressure in the intake passage downstream of the throttle valve;

means for calculating a basic fuel injection time based on the detected engine speed and intake-air pressure;

said detecting intake-air pressure includes detecting the intake-air pressure at every one rotation of a crankshaft of said engine;

means for calculating the difference between the detected intake-air pressures at a rotation of the crankshaft and one rotation of the crankshaft prior thereto;

means for correcting the basic fuel injection time by adding thereto a correcting value which is the product of said constant and said difference.

7. The apparatus according to claim 6, wherein said one rotation equals 360° of rotation of the crankshaft.

* * * * *